United States Patent [19]

Capps

[11] 4,222,054

[45] Sep. 9, 1980

[54] RADIO FREQUENCY LENS

[75] Inventor: Charles P. Capps, Goleta, Calif.

[73] Assignee: Raytheon Company, Lexington, Mass.

[21] Appl. No.: 955,846

[22] Filed: Oct. 30, 1978

[51] Int. Cl.[2] ..... H01Q 14/06

[52] U.S. Cl. ..... 343/754; 343/854

[58] Field of Search ..... 343/754, 771, 911 R, 343/854, 783

[56] References Cited

U.S. PATENT DOCUMENTS 3,761,936 9/1973 Archer et al. ..... 343/754

4,087,822 5/1978 Maybell et al. ..... 343/911 R 4,127,857 11/1978 Capps et al. ..... 343/754

*Primary Examiner*—David K. Moore

*Attorney, Agent, or Firm*—Richard M. Sharkansky; Joseph D. Pannone

[57] ABSTRACT

A printed circuit parallel plate radio frequency lens having a portion of its beam ports formed with a dielectric wedge disposed between a second and third dielectric material. The dielectric constant of the wedge is different from the dielectric constants of the second and third dielectric materials. Energy introduced into such beam port is separated by the dielectric materials and is directed toward array ports of the lens.

8 Claims, 4 Drawing Figures

RADIO FREQUENCY LENS

BACKGROUND OF THE INVENTION

This invention relates generally to radio frequency lenses and more particularly to parallel plate radio frequency lenses.

As is known in the art, parallel plate radio frequency lenses, such as the type described in U.S. Pat. No. 3,761,936 entitled "Multi-beam Array Antenna," inventors Donald H. Archer, Robert J. Prickett and Curtis P. Hartwig, issued Sept. 25, 1973, and assigned to the same assignee as the present invention, have been used in a wide variety of applications. One such application is described in U.S. Pat. No. 3,715,749, inventor Donald H. Archer, issued Feb. 6, 1973, and assigned to the same assignee as the present invention. As described therein, such parallel plate lens has a plurality of "array" ports which are coupled to an array of antenna elements and a plurality of "beam" ports, each one of which is associated with a corresponding beam of radio frequency energy. The "array" ports and the "beam" ports are disposed about the periphery of the lens. In some applications, the shape of the lens may be substantially elliptical, in which case the "array" ports and the "beam" ports are disposed about opposite, or "facing," portions of the periphery of the lens. In such applications, radiation from each of the "beam" ports, during transmit, illuminates all of the "array" ports. However, in some applications it is necessary that the parallel plate lens be substantially circular in shape with the "array" ports disposed about half the circumference of the lens periphery and the "beam" ports being disposed about the remaining half of the circumference of the lens periphery. While efficient illumination is obtained with the central "beam" ports, the end "beam" ports may not provide adequate illumination of the "array" ports which are adjacent the excited end "beam" ports, thereby reducing the overall effectiveness of the lens. One technique suggested to improve the illumination effectiveness of the end "beam" ports has been to tie pairs of the end "beam" ports together through a power divider and cables of different electrical lengths to, in effect, steer the radiation towards the "array" port portion of the lens periphery. While such technique may be used effectively in some applications, it does not lend itself readily to printed circuit manufacturing techniques.

SUMMARY OF THE INVENTION

In accordance with the present invention, a printed circuit parallel plate lens has a portion of the "beam" ports thereof formed with a dielectric wedge disposed between a second and third dielectric material, the dielectric constant of the wedge being different from the dielectric constants of the second and third dielectric materials. Energy introduced into such "beam" ports is refracted by the dielectric materials and is thereby directed toward the "array" port portion of the lens.

BRIEF DESCRIPTION OF THE DRAWINGS

For a more complete understanding of the invention, reference is made to the following description of a preferred embodiment in conjunction with the accompanying drawings in which.

DESCRIPTION OF THE PREFERRED EMBODIMENTS

Figure 1:
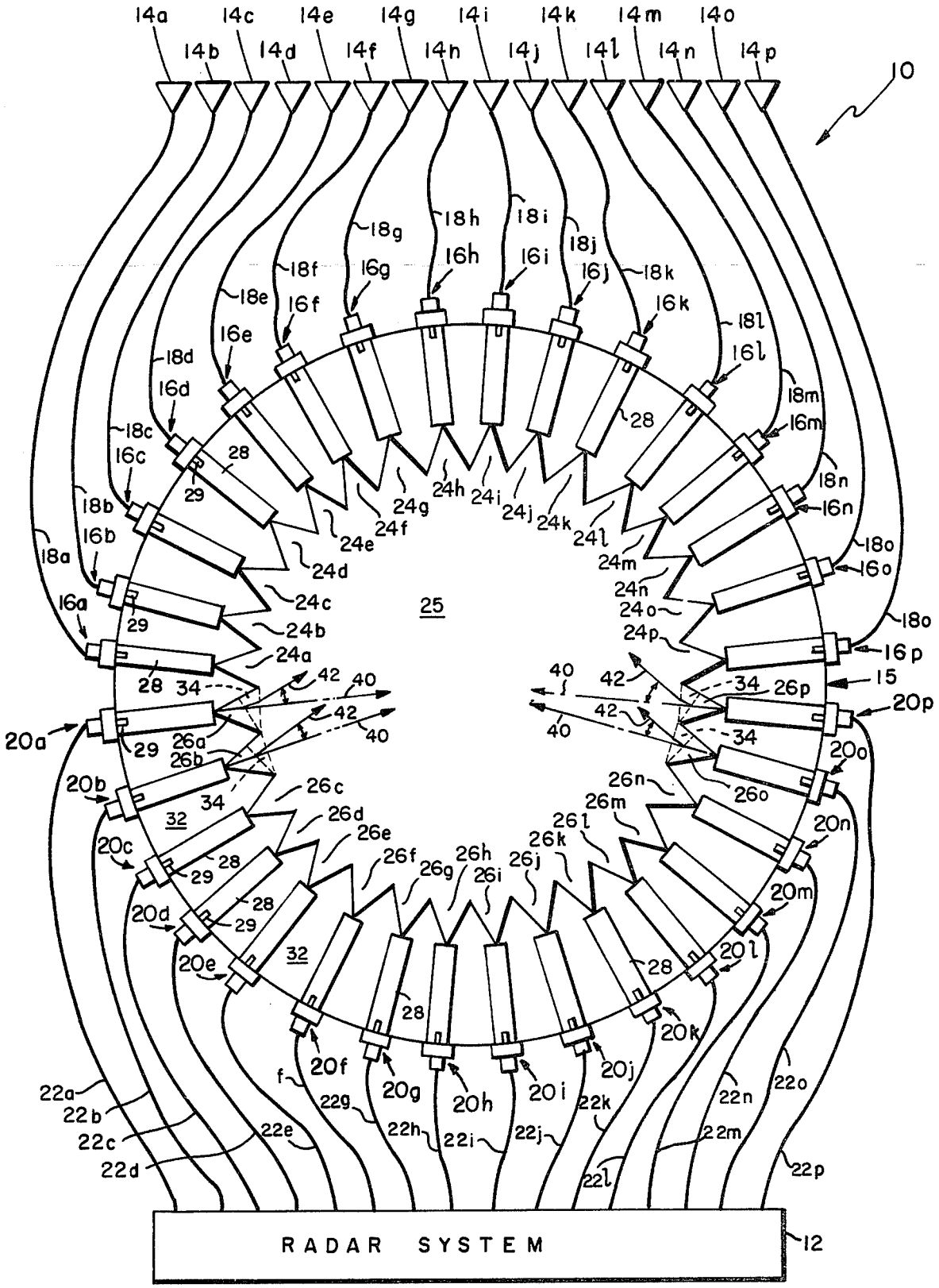
FIG. 1 is a plan view of a radio frequency lens assembly according to the invention coupled to an array of antenna elements to provide an array antenna for a radar system.

Referring now to FIG. 1, a multibeam array antenna 10 is shown coupled to a radar system 12 in a conventional manner. The multibeam array antenna 10 includes a plurality of antenna elements 14*a*–14*p*, each one being coupled to a corresponding one of a plurality of feed ports 16*a*–16*p* of a circular, printed circuit, disc-shaped parallel plate radio frequency lens assembly 15 through coaxial transmission lines 18*a*–18*p*, as shown. The radar system 12 is coupled to a second plurality of feed ports 20*a*–20*p* of the parallel plate lens assembly 15 through coaxial transmission lines 22*a*–22*p*, as shown.

Figure 4:
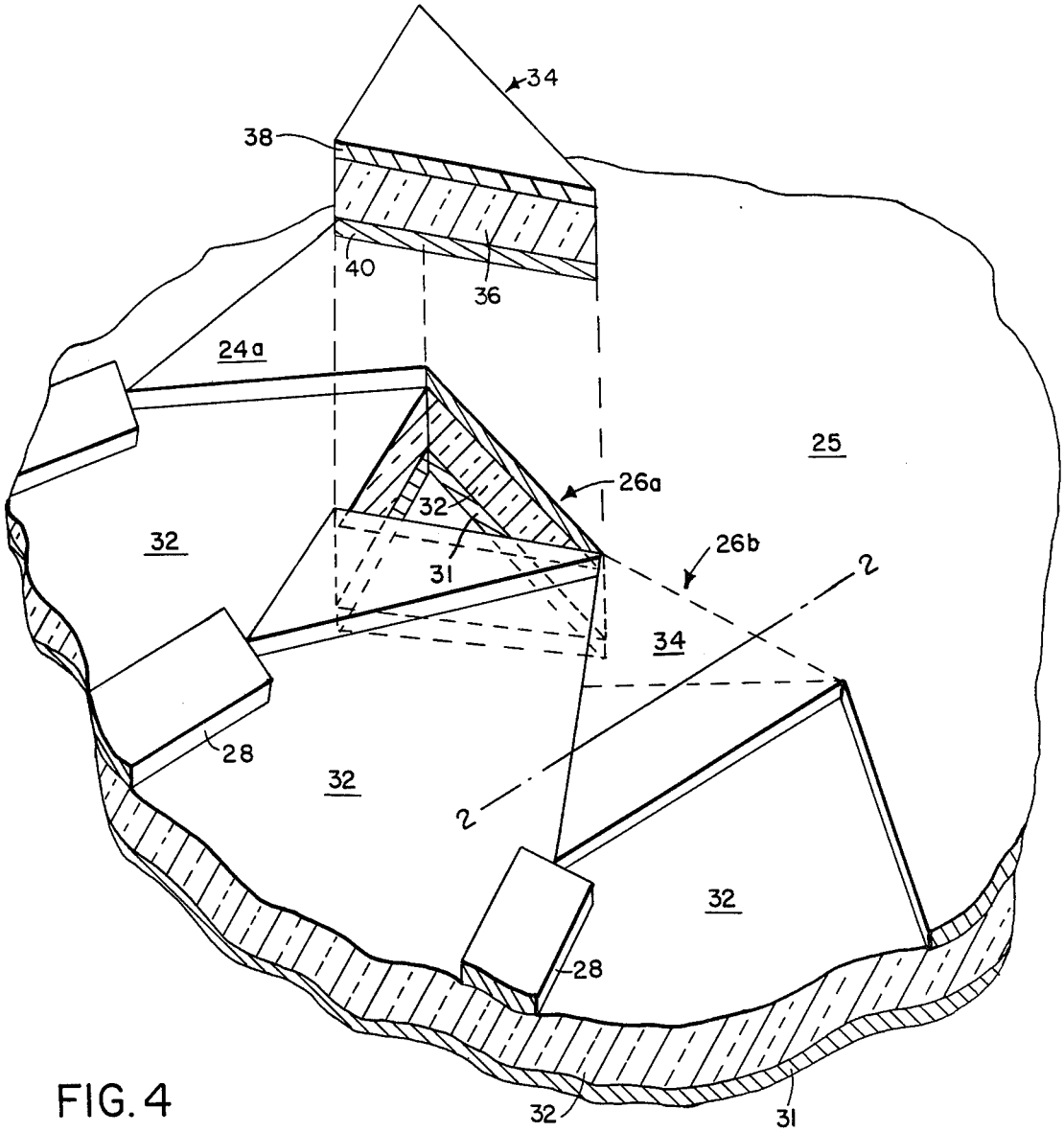
FIG. 4 is an isometric exploded drawing, partially in cross-section, showing a portion of the radio frequency lens assembly of FIG. 1.

The radio frequency lens assembly 15 includes a parallel plate region 25 coupled to the feed ports 16*a*–16*p* and 20*a*–20*p* through triangular-shaped matching sections 24*a*–24*p* and 26*a*–26*p* and strip conductors 28, as shown. The strip conductors 28 are electrically connected, as by solder, to the center conductors 29 of coaxial connectors 30 in a conventional manner. The parallel plate region 25, triangular-shaped matching sections 24*a*–24*p* and 26*a*–26*p* and strip conductors 28 are initially formed by taking a dielectric substrate 32 having copper clad on both sides thereof and etching away portions of the upper copper clad surface using conventional photolithographic-masking-chemical etching techniques to form a copper pattern as shown in FIG. 1, i.e., the parallel plate region 25, strip conductors 30 and matching sections 24*a*–24*p* and 26*a*–26*p*. The copper clad on the opposite surface serves as a ground plane for the printed circuit and is electrically connected to the outer conductor of the coaxial conductors 30 in a conventional manner. (The copper ground plane is shown in FIG. 4 and is labeled "31".) It is noted that the size and shape of the parallel plate lens assembly 15 and the lengths of the coaxial transmission lines connecting the array antenna elements 14*a*–14*p* to the lens assembly 15 are selected in accordance with conventional procedures as described in the above-referenced U.S. Pat. No. 3,761,936. Here it is noted that the parallel plate lens assembly is circular in shape. Further, the triangular-shaped matching sections 24*a*–24*p* which are coupled to the antenna elements 14*a*–14*p* may be considered as the "array" ports of the parallel plate lens assembly 15, and the triangular-shaped matching sections 26*a*–26*p* may be considered as the "beam" ports of the lens assembly 15 since each one of such "beam" ports is associated with a corresponding collimated beam of radio frequency energy as described in U.S. Pat. No. 3,715,749 referred to above. Thus, here the array antenna is adapted to produce sixteen differently directed, collimated beams of radio frequency energy.

Figure 2:
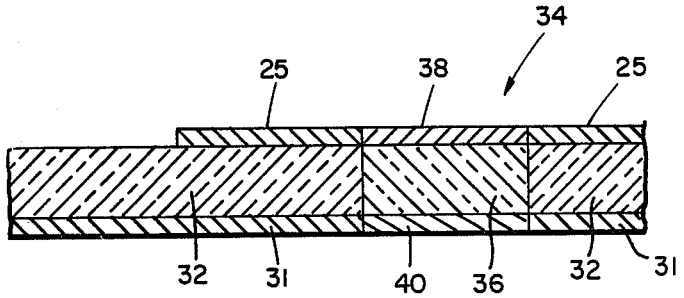
FIG. 2 is a cross-sectional elevation view of a "beam" port of the lens assembly of FIG. 1, such cross-section being taken along line 2—2 in FIG. 4.

Considering now the array antenna 10 in its "transmit" mode, but realizing that principles of reciprocity apply during the "receive" mode, it is noted that the centrally positioned "beam" ports (i.e., matching sections 26c to 26n) provide effective illumination to each of the "array" ports (matching sections 24a–24p) because they are positioned substantially "opposite" to such "array" ports. In order to provide effective illumination to all of the "array" port from the "beam" ports positioned at the extremes (i.e., the end "beam" ports 26a, 26b, 26o, 26p), a triangular-shaped wedge section 34 (FIG. 4) is inserted into the matching sections 26a, 26b, 26o and 26p. Such wedge assembly 34 includes a dielectric substrate 36 having copper clad on both surfaces thereof to form conductors 38, 40 as shown in FIGS. 2 and 4. The dielectric wedge assemblies 34 direct the rays associated with the radio frequency energy fed to the end "beam" ports 26a, 26b, 26o, 26p from their nominal paths, shown by dotted lines 40 in FIGS. 1 and 3, toward the "array" ports as shown by the solid lines 42 in FIGS. 1 and 3.

In particular, after the upper surface of the parallel plate assembly 15 is initially formed as described above, a triangular section is removed, by any conventional machining process, from the matching sections 24a, 26b, 24o, 26p as indicated in FIG. 4. The triangular-shaped wedge assemblies 34 are then inserted into the matching sections 26a, 26b, 26o, 26p and are affixed in place, here by a suitable epoxy, not shown. A conductive epoxy, not shown, is applied to the upper and lower surfaces of the matching sections 26a, 26b, 26o and 26p and to the surfaces 38, 40 of the wedge assemblies 34 to insure "ground" plane, or electrical, continuity across the upper and lower surfaces of the lens assembly 15.

Figure 3:
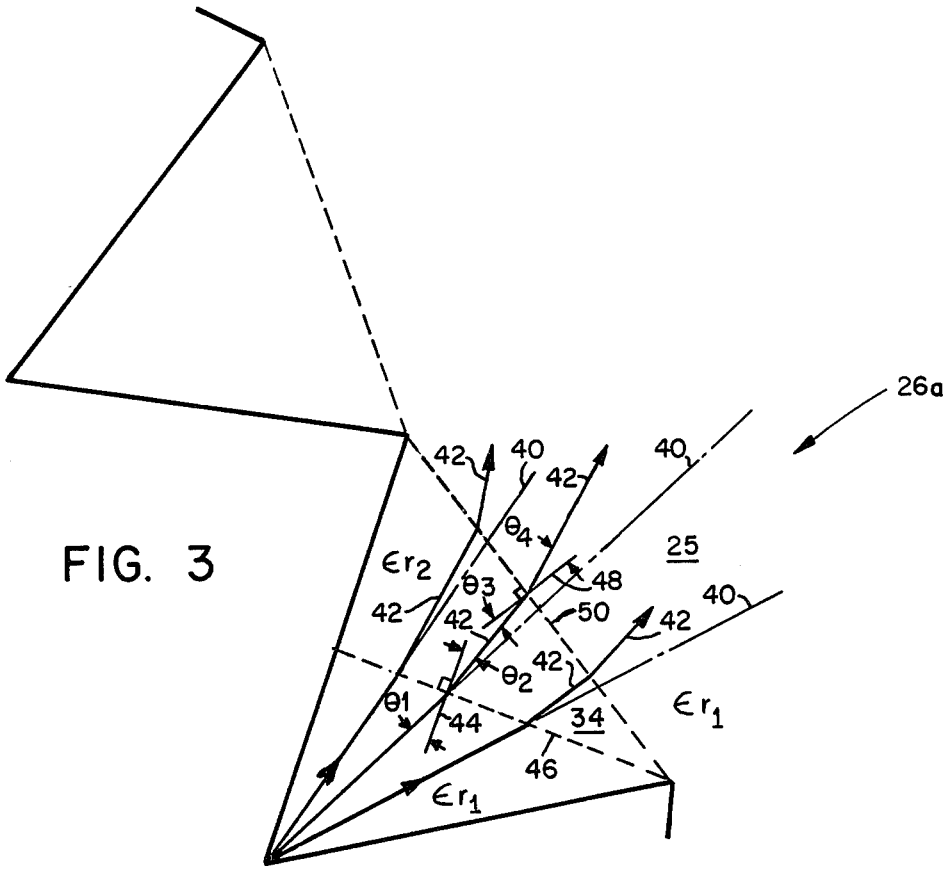
FIG. 3 is a diagram useful in understanding the effect of a wedge assembly in directing radio frequency energy between a "beam" port and a parallel plate region of the lens assembly.

The dielectric constants of the dielectric materials 36 of the wedge assemblies 34 are different from the dielectric constant of the substrate 32. In particular, the dielectric constant of the dielectric material 36, here having a dielectric constant $\epsilon_{r2}$, is greater than the dielectric constant of the substrate 32, here having a dielectric constant $\epsilon_{r1}$. Referring now to FIG. 3, on considering the effect of the wedge assembly 34 on "matching" section of one of the end "beam" ports, here end "beam" port 26a, it is first noted that absent such assembly 34 (i.e., in effect where $\epsilon_{r2}=\epsilon_{r1}$), the rays would follow nominal paths indicated by dotted lines 40. However, when the rays pass from the material of dielectric constant $\epsilon_{r1}$ to the material of dielectric constant $\epsilon_{r2}$, the rays bend to the left (i.e., towards the "array" ports 24a–24p) from the nominal ray 40 as shown by the solid lines 42. Further, when the rays 42 then pass from the wedge assembly 34 (i.e., having dielectric constant of $\epsilon_{r2}$) to the parallel plate region (i.e., having a dielectric constant of $\epsilon_{r1}$), the rays 42 bend further to the left as shown. More specifically, and considering the central ray, such ray intersects a normal 44 to the interface 46 between the apex of the matching section 26a and the wedge assembly 34 at an angle $\theta_1$. From Snell's Law, this ray will exist (or pass into the wedge assembly 34) at an angle $\theta_2$ with respect to the normal 44, as shown, where $$\theta_2 = \sin^{-1}\left(\sqrt{\frac{\epsilon_{r1}}{\epsilon_{r2}}}\sin\theta_1\right) \qquad \text{Eq. 1}$$

Such ray then passes into the parallel plate region 25 and intersects the normal 48 to the interface 50 between the wedge assembly 34 and the parallel plate region 25 at an angle $\theta_3$. Again from Snell's Law, the ray will pass into the parallel plate region 25 at an angle $\theta_4$ with respect to the normal 48, where $$\theta_4 = \sin^{-1}\left(\sqrt{\frac{\epsilon_{r2}}{\epsilon_{r1}}}\sin\theta_3\right) \qquad \text{Eq. 2}$$

It is noted that, because of the shape of the wedge assembly 34 and the fact that $\epsilon_{r2}>\epsilon_{r1}$, the angle $\theta_2$ is less than the angle $\theta_1$ and the angle $\theta_4$ is greater than the angle $\theta_3$ (i.e., $\theta_2<\theta_1$; $\theta_4>\theta_3$) and, hence, the rays 42 are bent or directed from their nominal paths 40 (as when $\epsilon_{r1}=\epsilon_{r2}$) more towards the direction of the "array" ports 24a–24p (FIG. 1), thereby enabling the extreme or end "beam" ports (26a, 26b, 26o, 26p) to provide effective illumination of each of the "array" ports 24a–24p.

Having described a preferred embodiment of the invention, it will now be evident that many changes and modifications may be made without departing from the inventive concepts. For example, the dielectric constant of the wedge assemblies and shapes of such assemblies may be different for each one of the "beam" ports in which such assemblies are used. It is felt, therefore, that this invention should not be restricted to the disclosed embodiment but rather should be limited only by the spirit and scope of the appended claims.

What is claimed is:

1. A radio frequency lens comprising:

(a) a dielectric substrate;

(b) a ground plane disposed on one surface of such substrate;

(c) a conductive material disposed on another surface of such substrate, a central portion of such conductive material forming a parallel plate region with a first portion of the ground plane, a portion of the periphery of such conductive material providing conductive members for a plurality of ports for the parallel plate region, such ports having dielectric material disposed between the conductive members and second portions of the ground plane, such dielectric material having a dielectric constant different from the dielectric constant of the substrate.

2. The radio frequency lens recited in claim 1 wherein the conductive members are triangular-shaped.

3. The radio frequency lens recited in claim 2 wherein the dielectric material is triangular-shaped.

4. A radio frequency lens comprising:

(a) a dielectric substrate;

(b) a ground plane disposed on one surface of such substrate; and (c) a conductive material disposed on another surface of such substrate, such conductive material having a central portion forming a parallel plate region with a first portion of the ground plane, a first portion of the periphery of the conductive material providing a conductive member for a port for the parallel plate region along a first portion of the periphery of the parallel plate region, such port comprising: means, including a dielectric material, disposed between the conductive member and a second portion of the ground plane having a dielectric constant different from the dielectric constant of the substrate, for refracting energy passing between the parallel plate region and the port from a nominal path between such port and a portion of the periphery of the parallel plate region opposite such port to a path between such port and a second portion of the peripheral region of the parallel plate region, such second portion of the periphery of the parallel plate region being disposed between the first portion of the periphery of the parallel plate region and the portion of the periphery of the parallel plate lens disposed opposite such port.

5. A radio frequency lens, comprising:

(a) a dielectric substrate;

(b) a ground plane disposed on one surface of such substrate; and (c) a conductive material disposed on another surface of such substrate, such conductive material having:

(i) a central portion forming a parallel plate region with a first portion of the ground plane, a first portion of such substrate being disposed between the central portion of the conductive material and the first portion of the ground plane; and (ii) a peripheral portion forming a conductive member for a port for the parallel plate region, a second portion of such substrate being disposed between a portion of such conductive member and a second portion of the ground plane, the dielectric constant of the first portion of the substrate being different from the dielectric constant of the second portion of the substrate.

6. The radio frequency lens recited in claim 5 wherein the conductive member is triangular-shaped.

7. The radio frequency lens recited in claim 6 wherein the second portion of the dielectric substrate is triangular-shaped.

8. The radio frequency lens recited in claim 7 wherein the dielectric constant of the second portion of the lens is greater than the dielectric constant of the first portion of the substrate.

* * * * *